US011430405B1

(12) United States Patent
Lee et al.

(10) Patent No.: US 11,430,405 B1
(45) Date of Patent: Aug. 30, 2022

(54) MANAGING A DISPLAY OF AN INFORMATION HANDLING SYSTEM

(71) Applicant: Dell Products L.P., Round Rock, TX (US)

(72) Inventors: Jongseo Lee, Austin, TX (US); Asim Mukarram Siddiqui, Cedar Park, TX (US); Deeder M. Aurongzeb, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/231,324

(22) Filed: Apr. 15, 2021

(51) Int. Cl.
*G09G 5/00* (2006.01)
*G09G 5/10* (2006.01)

(52) U.S. Cl.
CPC ..... *G09G 5/006* (2013.01); *G09G 5/10* (2013.01); *G09G 2320/0247* (2013.01); *G09G 2320/0252* (2013.01); *G09G 2320/0666* (2013.01); *G09G 2320/08* (2013.01); *G09G 2360/144* (2013.01)

(58) Field of Classification Search
None
See application file for complete search history.

(56) References Cited

U.S. PATENT DOCUMENTS

2012/0051658 A1* 3/2012 Tong ..... G11B 27/34 382/224
2013/0044146 A1* 2/2013 Kurokawa ..... G09G 3/3406 345/204
2015/0085158 A1* 3/2015 Kim ..... H04N 5/2357 348/226.1
2016/0086574 A1* 3/2016 Buckley ..... G09G 5/10 345/690
2016/0269714 A1* 9/2016 Rhemann ..... G06V 40/172
2017/0295276 A1* 10/2017 Wang ..... H04M 1/72454
2018/0272939 A1* 9/2018 Starke ..... G06T 5/003
2020/0074911 A1* 3/2020 Park ..... H04N 21/4318
2021/0400185 A1* 12/2021 Price ..... H04N 5/2257

* cited by examiner

*Primary Examiner* — Andre L Matthews
(74) *Attorney, Agent, or Firm* — Baker Botts, L.L.P.

(57) ABSTRACT

Managing a display of an information handling system, including: identifying a first magnitude of a frame rate of a display coupled to an information handling system; detecting an ambient light level of a physical environment surrounding the information handling system; determining that the ambient light level of the physical environment surrounding the information handling system is below a first threshold; in response to determining that the ambient light level of the physical environment surrounding the information handling system is below the first threshold: identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude; and reducing the frame rate of the display to the second magnitude.

14 Claims, 4 Drawing Sheets

MANAGING A DISPLAY OF AN INFORMATION HANDLING SYSTEM

BACKGROUND

Field of the Disclosure

The disclosure relates generally to an information handling system, and in particular, managing a display of the information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Gaming and online computer-implemented applications can reduce the lifetime of display devices of information handling systems, such as organic-light emitting diode (OLED) devices operating at 120 Hz or 240 Hz.

SUMMARY

Innovative aspects of the subject matter described in this specification may be embodied in a method of managing a display of an information handling system, the method including identifying a first magnitude of a frame rate of a display coupled to an information handling system; detecting an ambient light level of a physical environment surrounding the information handling system; determining that the ambient light level of the physical environment surrounding the information handling system is below a first threshold; in response to determining that the ambient light level of the physical environment surrounding the information handling system is below the first threshold: identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude; and reducing the frame rate of the display to the second magnitude.

Other embodiments of these aspects include corresponding systems, apparatus, and computer programs, configured to perform the actions of the methods, encoded on computer storage devices.

These and other embodiments may each optionally include one or more of the following features. For instance, accessing a database that stores correspondence between ambient light levels and magnitudes of frame rates; and identifying, from the database, the second magnitude of the frame rate of the display that corresponds to the ambient light level of the physical environment surrounding the information handling system. Determining that the ambient light level of the physical environment surrounding the information handling system is below a second threshold, the second threshold less than the first threshold; in response to determining that the ambient light level of the physical environment surrounding the information handling system is below the second threshold: identifying a third magnitude of the frame rate of the display that corresponds to the ambient light level, wherein the third magnitude is a flicker fusion rate of the display for the ambient light level of the physical environment surrounding the information handling system, wherein the third magnitude is less than the second magnitude; and reducing the frame rate of the display to the third magnitude. An ambient light sensor (ALS) detects the ambient light level of the physical environment surrounding the information handling system. Identifying a first portion of a graphical user interface (GUI) of the display, the first portion being in a foreground of the GUI; identifying a second portion of the GUI, the second portion being in a background of the GUI; and reducing the frame rate of the display to the second magnitude that corresponds to the second portion of the GUI. Maintaining the frame rate of the display of the first magnitude that corresponds to the first portion of the GUI while reducing the frame rate of the monitor that correspond to the second portion of the GUI. Reducing a color saturation of the display that correspond to the second portion of the GUI.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
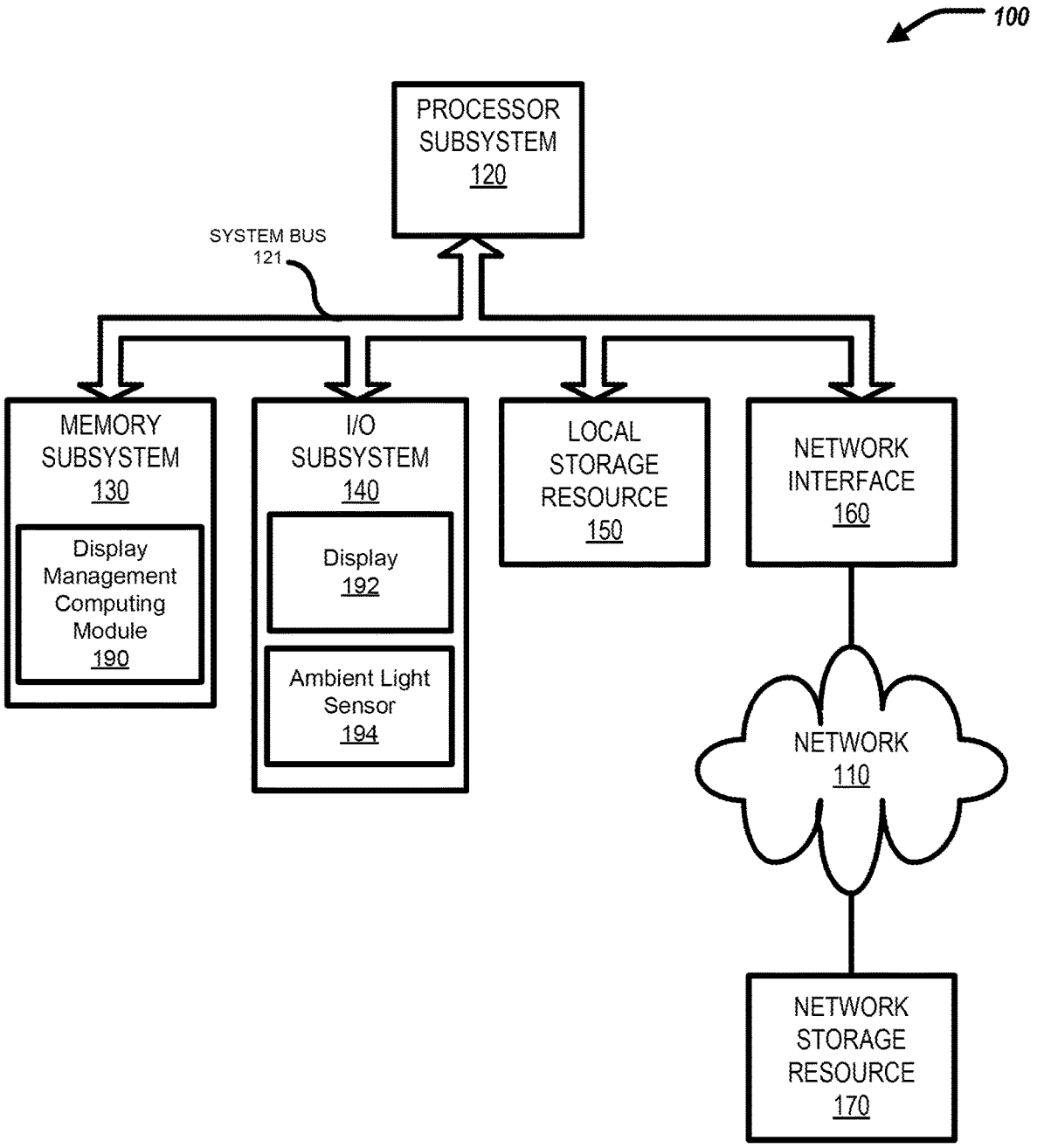
FIG. 1 is a block diagram of selected elements of an embodiment of an information handling system.

This disclosure discusses methods and systems for managing a display of an information handling system. A display management computing module can dynamically adjust a refresh rate of a display when an ambient light level (as detected by an ambient light sensor) of an environment of the information handling system is below a threshold. The refresh rate of the display can be reduced to a level to save power, while preventing display flicker of the display (based on the ambient light level), described further herein.

Specifically, this disclosure discusses a system and a method for managing a display of an information handling system, the method including identifying a first magnitude of a frame rate of a display coupled to an information handling system; detecting an ambient light level of a physical environment surrounding the information handling system; determining that the ambient light level of the physical environment surrounding the information handling system is below a first threshold; in response to determining that the ambient light level of the physical environment surrounding the information handling system is below the first threshold: identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude; and reducing the frame rate of the display to the second magnitude.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-4 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device. For example, the I/O subsystem can include a display 192 and an ambient light sensor (ALS) 194.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

The information handling system 100 can also include a display management computing module 190. The display management computing module 190 can be included by the memory subsystem 130. The display management computing module 190 can include a computer-executable program (software). The display management computing module 190 can be executed by the processor subsystem 120.

In short, the display management computing module 190 can dynamically adjust a refresh rate of the display 218 when an ambient light level (as detected by the ALS 194) of an environment of the information handling system 100 is below a threshold. The refresh rate of the display 218 can be reduced to a level to save power, while preventing display flicker of the display 218 (based on the ambient light level), described further herein.

Figure 2:
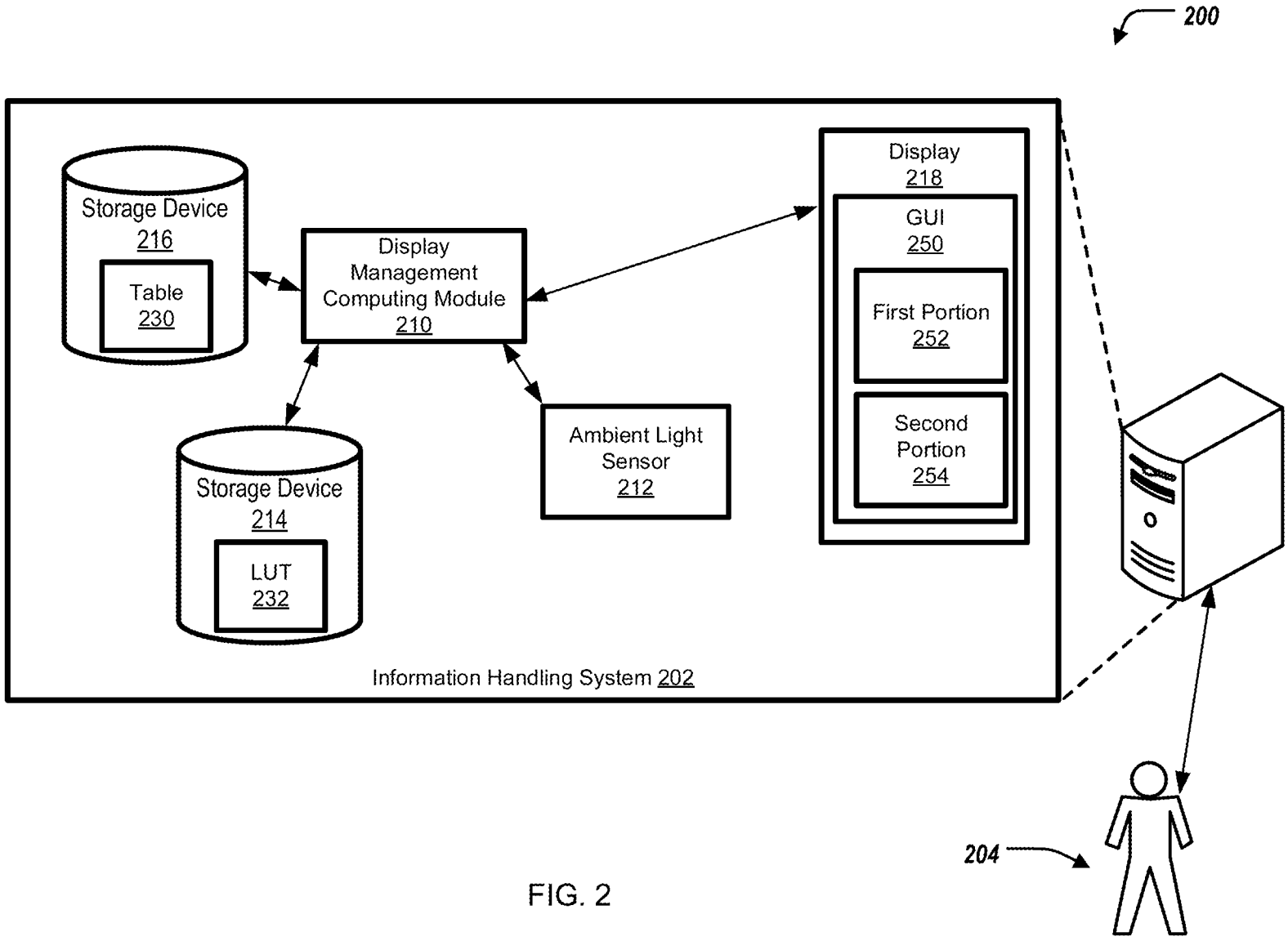
FIG. 2 illustrates a block diagram of an information handling system for managing a display of the information handling system.

Turning to FIG. 2, FIG. 2 illustrates an environment 200 including an information handling system 202. The environment 200 can include a physical environment surround the information handling system 202 and/or a computing environment of the information handling system 202. The information handling system 202 can include a display management computing module 210, an ambient light sensor (ALS) 212, a storage device 214, a storage device 216, and a display 218. In some examples, the information handling system 202 is similar to, or includes, the information handling system 100 of FIG. 1. In some examples, the display management computing module 210 is the same, or substantially the same, as the display management computing module 190 of FIG. 1. In some examples, the ALS 212 is the same, or substantially the same, as the ALS 194 of FIG. 1. In some examples, the display 218 is the same, or substantially the same, as the display 192 of FIG. 1. The display management computing module 210 can be in communication with the ALS 212, the storage device 214, the storage device 216, and the display 218.

The display management computing module 210 can identify a first magnitude of a frame rate of the display 218 coupled to the information handling system 202. That is, at a first time (or initial time), the display 218 can be associated with (or have) a frame rate (or refresh rate) having a first magnitude (i.e., a first frame rate). For example, the display 218 can have a frame rate of greater than 40 Hz. For example, the display 218 can have a frame rate of approximately 50 Hz (Phase Alternating Line—"PAL"). For example, the display 218 can have a frame rate of approximately 60 Hz (National Television System Committee—"NTSC").

The ALS 212 can detect an ambient light level of the (physical) environment 200 of the information handling system 202. For example, the ambient light level can be represented as candela per meter squared (cd/m$^2$), lumens per meter squared, or foot-candles. The ALS 212 can transmit data indicating the ambient light level of the environment 200 to the display management computing module 210. The display management computing module 210 can receive the data indicating the ambient light level of the environment 200.

The display management computing module 210 can compare the ambient light level of the environment 200 surrounding the information handling system 202 to one or more thresholds. Specifically, the storage device 216 can store, or provide access to, a table 230 storing data indicate the one or more thresholds. The thresholds can be predetermined (e.g., by a manufacturer of the display 218 and/or the information handling system 202) or set by a user 204 of the information handling system 202.

The display management computing module 210 can determine, based on the comparing, that the ambient light level of the environment 200 is below a first threshold. For example, the first threshold can be 3,000 candela per meter squared (cd/m$^2$), with the ambient light level of the environment 200 below 3,000 cd/m$^2$. The displaying management computing module 210 can, in response to determining that the ambient light level of the environment 200 is below the first threshold, identify a second magnitude of the frame rate (e.g., a second frame rate) that corresponds to the ambient light level that is detected by the ALS 212. Specifically, the storage device 214 can store, or provide access to, a look-up table (LUT) 232 (or database 232) that stores correspondences between ambient light levels and magnitudes of frame rates. That is, for each ambient light level (or range of ambient light levels), the LUT 232 can identify a corresponding frame rate (or range of frame rates). The display management computing module 210 can access the LUT 232 through the storage device 214 to identify the second magnitude of the frame rate of the display 218 that corresponds to the current ambient light level of the environment 200.

The second magnitude of the frame rate of the display 218 is a flicker fusion rate (or critical fusion frequency—"CFF") of the display 218 for the current ambient light level of the environment 200. That is, the flicker fusion rate is a threshold frequency at which flicker (e.g., a visible change in brightness between cycles displayed on the display 218) can be detected/perceived by the user 204. In some examples, the second magnitude of the frame rate of the display 218 is less than the first magnitude of the frame rate of the display 218.

For example, the ambient light level can indicate that the environment 200 can indicate a "dark" condition—the information handling system 202 is in a poorly lit environment, or an environment with no external light source. For example, the ambient light level of the environment 200 can be 500 cd/m$^2$. The display management computing module 210 can compare the ambient light level with the first threshold. For example, the first threshold can be 3,000 cd/m$^2$. The display management computing module 210 can identify a second magnitude of the frame rate of the display 218 that corresponds to the ambient light level of 500 cd/m$^2$. For example, the display management computing module 210, can access the LUT 232 to identify a frame rate that corresponds to the ambient light level of 500 cd/m$^2$. For example, for the ambient light level of 500 cd/m$^2$, the LUT 232 can indicate a magnitude of the frame rate as 20 Hz.

Furthermore, the display management computing module 210 can, in response to determining that the ambient light level of the environment 200 is below the first threshold, reduce the frame rate of the display 218 to the second magnitude. For example, the display management computing module 210 can reduce the frame rate of the display 218 to 20 Hz (e.g., from 60 Hz). Continuing the example, the ALS 212 can detect the ambient light level of the environment 200 (e.g., 500 cd/m$^2$). The display management computing module 210 can compare the ambient light level of the environment 200 (e.g., 500 cd/m$^2$) with the first threshold (e.g., 3,000 cd/m$^2$). The display management computing module 210 can access the LUT 232 to identify a frame rate (e.g., 20 Hz) that corresponds to the ambient light level of 500 cd/m$^2$. The display management computing module 210 can reduce the frame rate at the display 218 to identified frame rate—e.g., 20 Hz.

In some examples, the display management computing module 210 can determine, based on the comparing, that the ambient light level of the environment 200 is below a second threshold. In some examples, the second threshold is less than the first threshold. For example, the second threshold can be 300 candela per meter squared (cd/m$^2$), with the ambient light level of the environment 200 below 300 cd/m$^2$. The display management computing module 210 can, in response to determining that the ambient light level of the environment 200 is below the second threshold, identify a third magnitude of the frame rate (e.g., a third frame rate) that corresponds to the ambient light level that is detected by the ALS 212. The display management computing module 210 can access the LUT 232 through the storage device 214 to identify the third magnitude of the frame rate of the display 218 that corresponds to the current ambient light level of the environment 200.

The third magnitude of the frame rate of the display 218 is a flicker fusion rate (or critical fusion frequency—"CFF") of the display 218 for the current ambient light level of the environment 200. In some examples, the third magnitude of the frame rate of the display 218 is less than the second magnitude of the frame rate of the display 218.

For example, the ambient light level of the environment 200 can be 100 cd/m$^2$. The display management computing module 210 can compare the ambient light level with the second threshold. For example, the second threshold can be 300 cd/m$^2$. The display management computing module 210 can identify the third magnitude of the frame rate of the display 218 that corresponds to the ambient light level of 100 cd/m$^2$. For example, the display management computing module 210, can access the LUT 232 to identify a frame rate that corresponds to the ambient light level of 100 cd/m$^2$. For example, for the ambient light level of 100 cd/m$^2$, the LUT 232 can indicate a magnitude of the frame rate as 10 Hz.

Furthermore, the displaying management computing module 210 can, in response to determining that the ambient light level of the environment 200 is below the second threshold, reduce the frame rate of the display 218 to the third magnitude. For example, the display management computing module 210 can reduce the frame of the display 218 to 10 Hz (e.g., from 60 Hz). Continuing the example, the ALS 212 can detect the ambient light level of the environment 200 (e.g., 100 cd/m$^2$). The display management computing module 210 can compare the ambient light level of the environment 200 (e.g., 100 cd/m$^2$) with the second threshold (e.g., 300 cd/m$^2$). The display management computing module 210 can access the LUT 232 to identify a frame rate (e.g., 10 Hz) that corresponds to the ambient light level of 100 cd/m$^2$. The display management computing module 210 can reduce the frame rate at the display 218 to identified frame rate—e.g., 10 Hz.

Figure 3:
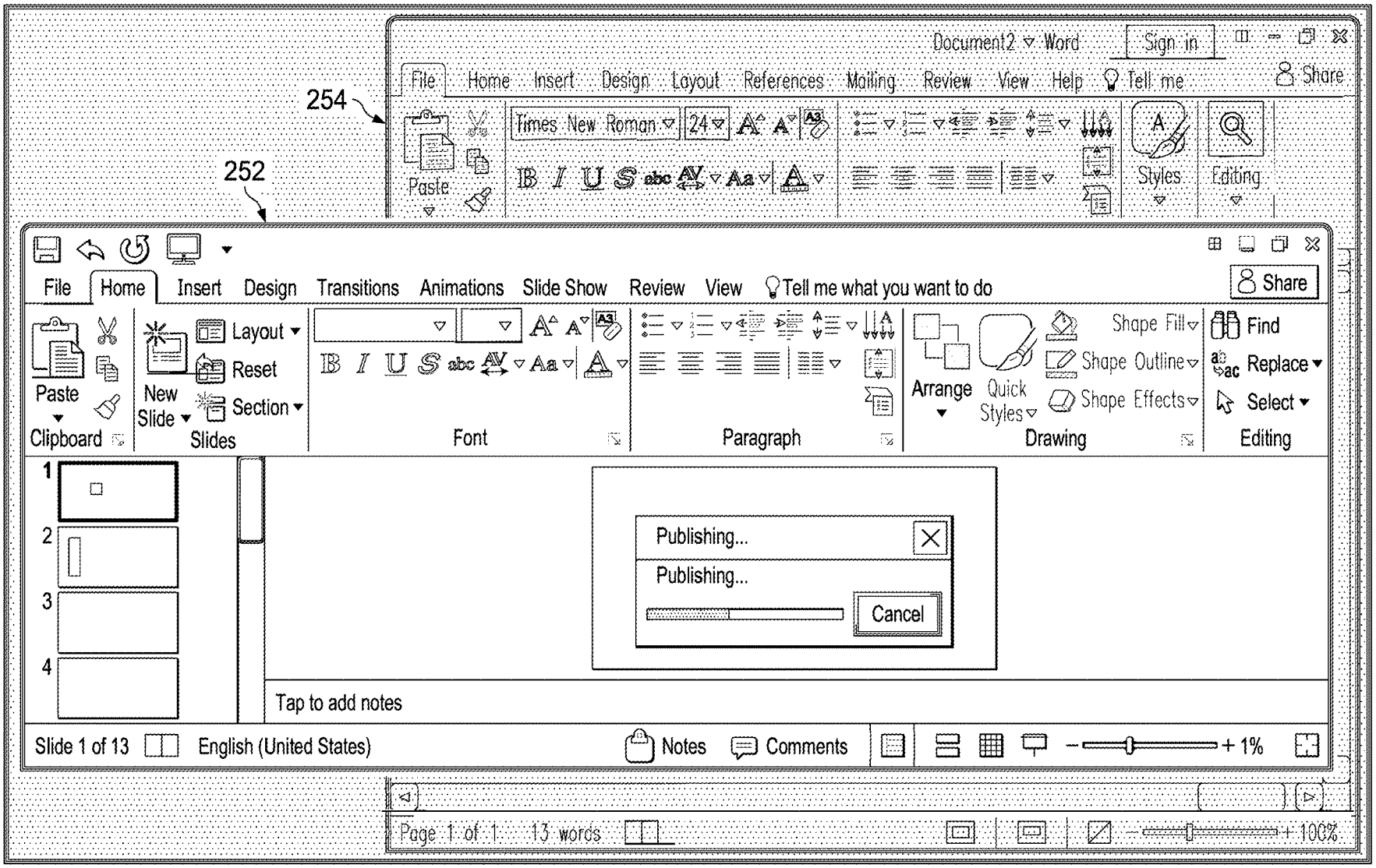
FIG. 3 illustrates a graphical user interface of the display.

In some examples, the display management computing module 210 can reduce the frame rate of a portion of the display 218. In particular, the display 218 can include a graphical user interface (GUI) 250. The GUI 250 can include a first portion 252 and a second portion 254. The display management computing module 210 can identify the first portion 252 of the GUI 250, with the first portion 252 of the GUI 250 being in a foreground of the GUI 250, as shown in FIG. 3. The display management computing module 210 can further identify the second portion 254 of the GUI 250, with the second portion 254 of the GUI 250 being in a background of the GUI 250, as shown in FIG. 3. To that end, the display management computing module 210 can reduce the frame rate of the display 218 to the second magnitude that corresponds to the second portion 254 of the GUI 250. That is, the display management computing module 210, upon identifying the second portion 254 of the GUI 250 as being in the background, and further in response to determining that the ambient light level of the environment 200 is below the first threshold, can reduce the frame rate of the display 218 to the second magnitude that corresponds to the second portion 254 of the GUI 250.

In some examples, the display management computing module 210, upon identifying the second portion 254 of the GUI 250 as being in the background, and further in response to determining that the ambient light level of the environment 200 is below the first threshold, can reduce the frame rate of the display 218 to the second magnitude that corresponds to the second portion 254 of the GUI 250 while maintaining the frame rate of the display 218 of the first magnitude that corresponds to the first portion 252.

In some examples, the display management computing module 210, upon identifying the second portion 254 of the GUI 250 as being in the background, and further in response to determining that the ambient light level of the environment 200 is below the first threshold, can adjust one or more other display parameters of the 218 that correspond to the second portion 254 of the GUI 250. For example, the display management computing module 210, upon identifying the second portion 254 of the GUI 250 as being in the background, and further in response to determining that the ambient light level of the environment 200 is below the first threshold, can reduce a color saturation of the display 218 that corresponds to the second portion 254 of the GUI 250. For example, reducing the color saturation of the display 218 can include reducing a blue color saturation, or reducing the color saturation completely to black and white (grayscale). In some examples, the display management computing module 210, upon identifying the second portion 254 of the GUI 250 as being in the background, and further in response to determining that the ambient light level of the environment 200 is below the first threshold, can reduce a resolution of the second portion 254 of the GUI 250, and/or increase a transparency of the second portion 254 of the GUI 250. In some examples, the display management computing module 210, upon identifying the second portion 254 of the GUI 250 as being in the background, and further in response to determining that the ambient light level of the environment 200 is below the first threshold, can further maintain the display characteristics of the first portion 252 of the GUI 250 (e.g., color saturation, resolution, transparency) while adjusting the display characteristics of the second portion 254 of the GUI 250 (e.g., color saturation, resolution, transparency).

In some examples, the information handling system 202 can include an additional display (not shown). The displaying management computing module 210 can, in response to determining that the ambient light level of the environment 200 is below the first threshold, reduce the frame rate of the display 218, the additional display, or both, to the second magnitude. Continuing the example, the ALS 212 can detect the ambient light level of the environment 200 (e.g., 500 cd/m$^2$). The display management computing module 210 can compare the ambient light level of the environment 200 (e.g., 500 cd/m$^2$) with the first threshold (e.g., 3,000 cd/m$^2$). The display management computing module 210 can access the LUT 232 to identify a frame rate (e.g., 20 Hz) that corresponds to the ambient light level of 500 cd/m$^2$. The display management computing module 210 can reduce the frame rate at the display 218, the additional display, or both, to identified frame rate—e.g., 20 Hz.

Figure 4:
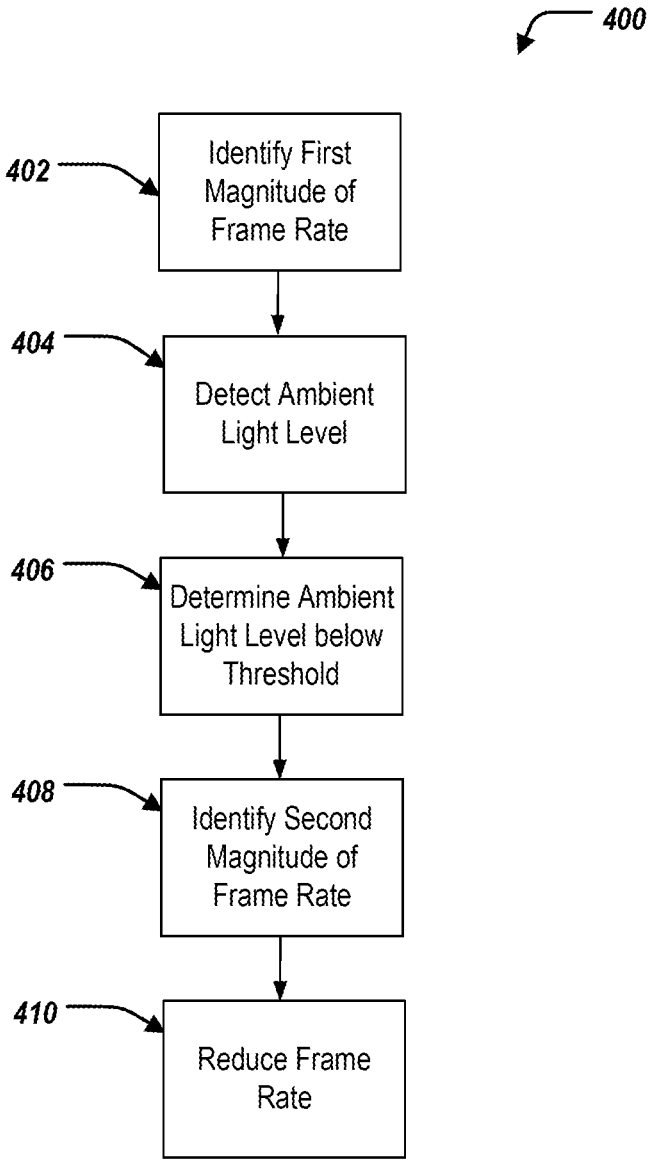
FIG. 4 illustrates a method for managing the display of the information handling system.

FIG. 4 illustrates a flowchart depicting selected elements of an embodiment of a method 400 for managing a display of an information handling system. The method 400 may be performed by the information handling system 100, the information handling system 202 and/or the display management computing module 210, and with reference to FIGS. 1-3. It is noted that certain operations described in method 400 may be optional or may be rearranged in different embodiments.

The display management computing module 210 identifies a first magnitude of a frame rate of the display 218 coupled to an information handling system 202 (402). The ALS 212 detects an ambient light level of the physical environment 200 surrounding the information handling system 202 (404). The display management computing module 210 determining that the ambient light level of the physical environment surrounding the information handling system is below a first threshold (406). The display management computing module 210, in response to determining that the ambient light level of the physical environment 200 surrounding the information handling system 202 is below the first threshold, identifies a second magnitude of the frame rate of the display 218 that corresponds to the ambient light level (408). The display management computing module 210, in response to determining that the ambient light level of the physical environment 200 surrounding the information handling system 202 is below the first threshold, reduces the frame rate of the display 218 to the second magnitude (410).

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A computer-implemented method of managing a display of an information handling system, the method comprising:

identifying a first magnitude of a frame rate of a display coupled to an information handling system, the display including a graphical user interface (GUI) having a foreground portion and a background portion;

detecting an ambient light level of a physical environment surrounding the information handling system;

determining that the ambient light level of the physical environment surrounding the information handling system is below a first threshold;

in response to determining that the ambient light level of the physical environment surrounding the information handling system is below the first threshold:

identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude;

reducing the frame rate of the display to the second magnitude that corresponds to the background portion of the GUI while maintaining the frame rate of the display of the first magnitude that correspond to the foreground portion of the GUI.

2. The computer-implemented method of claim 1, further comprising:

accessing a database that stores correspondence between ambient light levels and magnitudes of frame rates; and identifying, from the database, the second magnitude of the frame rate of the display that corresponds to the ambient light level of the physical environment surrounding the information handling system.

3. The computer-implemented method of claim 1, further comprising:

determining that the ambient light level of the physical environment surrounding the information handling system is below a second threshold, the second threshold less than the first threshold;

in response to determining that the ambient light level of the physical environment surrounding the information handling system is below the second threshold:

identifying a third magnitude of the frame rate of the display that corresponds to the ambient light level, wherein the third magnitude is a flicker fusion rate of the display for the ambient light level of the physical environment surrounding the information handling system, wherein the third magnitude is less than the second magnitude; and reducing the frame rate of the display to the third magnitude.

4. The computer-implemented method of claim 1, wherein an ambient light sensor (ALS) detects the ambient light level of the physical environment surrounding the information handling system.

5. The computer-implemented method of claim 1, further comprising:

reducing a color saturation of the display that correspond to the second background portion of the GUI.

6. An information handling system comprising:

a display, the display including a graphical user interface (GUI) having a foreground portion and a background portion;

an ambient light sensor configured to detect an ambient light level of a physical environment surrounding the information handling system; and a processor having access to memory media storing instructions executable by the processor to perform operations comprising, comprising:

identifying a first magnitude of a frame rate of a display coupled to an information handling system;

determining that the ambient light level of the physical environment surrounding the information handling system is below a first threshold;

in response to determining that the ambient light level of the physical environment surrounding the information handling system is below the first threshold:

identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude; and reducing the frame rate of the display to the second magnitude that corresponds to the background portion of the GUI while maintaining the frame rate of the display of the first magnitude that correspond to the foreground portion of the GUI.

7. The information handling system of claim 6, the operations further comprising:

accessing a database that stores correspondence between ambient light levels and magnitudes of frame rates; and identifying, from the database, the second magnitude of the frame rate of the display that corresponds to the ambient light level of the physical environment surrounding the information handling system.

8. The information handling system of claim 6, the operations further comprising:

determining that the ambient light level of the physical environment surrounding the information handling system is below a second threshold, the second threshold less than the first threshold;

in response to determining that the ambient light level of the physical environment surrounding the information handling system is below the second threshold:

identifying a third magnitude of the frame rate of the display that corresponds to the ambient light level, wherein the third magnitude is a flicker fusion rate of the display for the ambient light level of the physical environment surrounding the information handling system, wherein the third magnitude is less than the second magnitude; and reducing the frame rate of the display to the third magnitude.

9. The information handling system of claim 6, wherein an ambient light sensor (ALS) detects the ambient light level of the physical environment surrounding the information handling system.

10. The information handling system of claim 6, the operations further comprising:

reducing a color saturation of the display that correspond to the second background portion of the GUI.

11. A non-transitory computer-readable medium storing software comprising instructions executable by one or more computers which, upon such execution, cause the one or more computers to perform operations comprising:

identifying a first magnitude of a frame rate of a display coupled to an information handling system, the display including a graphical user interface (GUI) having a foreground portion and a background portion;

detecting an ambient light level of a physical environment surrounding the information handling system;

determining that the ambient light level of the physical environment surrounding the information handling system is below a first threshold;

in response to determining that the ambient light level of the physical environment surrounding the information handling system is below the first threshold:

identifying a second magnitude of the frame rate of the display that corresponds to the ambient light level, wherein the second magnitude is a flicker fusion rate of the display for the ambient light level of the physical environment surrounding the information handling system, wherein the second magnitude is less than the first magnitude; and reducing the frame rate of the display to the second magnitude that corresponds to the background portion of the GUI while maintaining the frame rate of the display of the first magnitude that correspond to the foreground portion of the GUI.

12. The computer-readable medium of claim 11, the operations further comprising:

accessing a database that stores correspondence between ambient light levels and magnitudes of frame rates; and identifying, from the database, the second magnitude of the frame rate of the display that corresponds to the ambient light level of the physical environment surrounding the information handling system.

13. The computer-readable medium of claim 11, the operations further comprising:

determining that the ambient light level of the physical environment surrounding the information handling system is below a second threshold, the second threshold less than the first threshold;

in response to determining that the ambient light level of the physical environment surrounding the information handling system is below the second threshold:

identifying a third magnitude of the frame rate of the display that corresponds to the ambient light level, wherein the third magnitude is a flicker fusion rate of the display for the ambient light level of the physical environment surrounding the information handling system, wherein the third magnitude is less than the second magnitude; and reducing the frame rate of the display to the third magnitude.

14. The computer-readable medium of claim 11, wherein an ambient light sensor (ALS) detects the ambient light level of the physical environment surrounding the information handling system.

* * * * *